US012734409B2

(12) United States Patent
Cottrill

(10) Patent No.: US 12,734,409 B2
(45) Date of Patent: Sep. 15, 2026

(54) PIVOTABLE SWIM FIN DEVICE

(71) Applicant: Shelley Cottrill, Carson City, NV (US)

(72) Inventor: Shelley Cottrill, Carson City, NV (US)

( * ) Notice: Subject to any disclaimer, the term of this patent is extended or adjusted under 35 U.S.C. 154(b) by 720 days.

(21) Appl. No.: 18/098,694

(22) Filed: Jan. 19, 2023

(65) Prior Publication Data

US 2024/0245958 A1 Jul. 25, 2024

(51) Int. Cl.
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/11; A63B 2031/112
See application file for complete search history.

(56) References Cited

U.S. PATENT DOCUMENTS 3,178,738 A * 4/1965 La Trell ..... A63B 31/11 441/64
3,908,213 A * 9/1975 Hill ..... A63B 31/11 441/64
4,981,454 A * 1/1991 Klein ..... A63B 31/11 441/62
5,108,327 A * 4/1992 Klein ..... A63B 31/11 441/62
5,292,272 A * 3/1994 Grim ..... A63B 31/11 441/62
6,129,601 A * 10/2000 Aucoin ..... A63B 31/11 441/64
7,462,085 B2 * 12/2008 Moyal ..... A63B 31/11 441/64
7,470,164 B2 * 12/2008 Moyal ..... A63B 31/11 441/64

FOREIGN PATENT DOCUMENTS

DE 19815732 C1 * 6/1999 ..... A63B 31/11
FR 2813534 A1 * 3/2002 ..... A63B 31/11

* cited by examiner

*Primary Examiner* — Anthony D Wiest
(74) *Attorney, Agent, or Firm* — Mark A. Goodman; Goodman Law Center, P.C.

(57) ABSTRACT

A pivotable swim fin device includes a footwear element, such as a boot, and a fin element pivotably attached thereto. The fin element is able to be moved between a downward 'swim' position and an upward 'walking' position, thereby enabling the pivotable swim fin device to be used in the downward position for water activities such as snorkeling, scuba diving, etc.; and in the upward position for walking on land unobstructed.

11 Claims, 9 Drawing Sheets

PIVOTABLE SWIM FIN DEVICE

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of swimming aids of existing art and more specifically relates to a pivotable swim fin.

RELATED ART

Swim fins are devices worn about the limbs of a wearer (either the feet or hands) and used to aid in movement and improved propulsion of the wearer through water. As such, swim fins are popular for water activities such as scuba diving, snorkeling, diving, etc. Swim fins typically include a finlike elongated blade having an opening at one end for receiving a foot of the wearer, thereby attaching the swim fin to the foot. As advantageous as swim fins are for water activities, due to their size, they are difficult and cumbersome to walk in on land. This means that the swim fins need to be removed when the wearer needs to walk. This is time consuming to have to repeatedly remove the swim fins, especially as the opening attaching the swim fin to the foot tends to be skintight (particularly when wet) which makes removal of the swim fin challenging. As such, a suitable solution is desired.

SUMMARY OF THE INVENTION

In view of the foregoing disadvantages inherent in the known swim fin art, the present disclosure provides a novel pivotable swim fin device. The general purpose of the present disclosure, which will be described subsequently in greater detail, is to provide footwear having a pivotable swim fin attached thereto that is usable both in a swim position for water activities, and a walking position for unobstructed walking on land.

A swim fin device is disclosed herein. The swim fin device may comprise a footwear element and a fin element. The footwear element is configured for wear on a foot of a user and may include an opening to receive the foot of the user, a front side opposite a rear side relative to the user, and a toe portion at the front side. The fin element may be pivotably connected to the footwear element such that the fin element is movable between a swim position and a walking position. The fin element may include a body having a longitudinal axis defining a front end opposite a rear end and may be hydrodynamically shaped to aid in movement of the user through water when in the swim position. In some embodiments, the footwear element may include a boot element.

According to another embodiment, a swim fin device may configured to attach to an existing footwear item. In this embodiment, the swim fin device may include a fin element, a pivot element and a pair of arms. The fin element may include a body having a longitudinal axis defining a front end opposite a rear end and being hydrodynamically shaped to aid in movement of a user through water. The pivot element may be configured to attach the fin element to a footwear item and facilitate pivotable movement of the fin element relative to the footwear item, between a swim position and a walking position. The pivot element may include a pair of circular members attachable at opposing sides of the footwear item and each of the pair of arms may be attached between one of the pair of circular members and one side of the fin element.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a pivotable swim fin device, constructed and operative according to the teachings of the present disclosure.

The various embodiments of the present invention will hereinafter be described in conjunction with the appended drawings, wherein like designations denote like elements.

DETAILED DESCRIPTION

Figure 1:
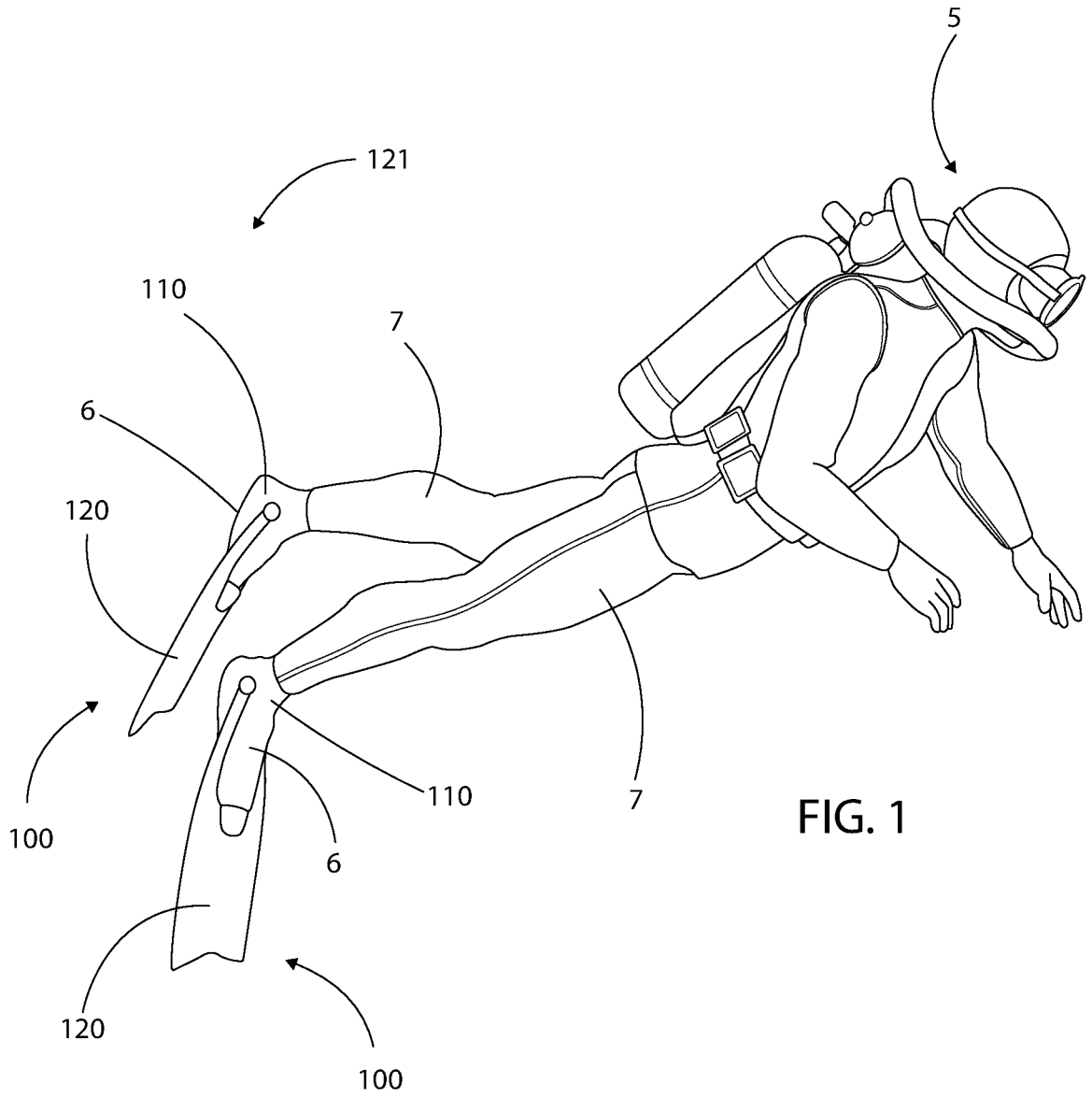
FIG. 1 is a perspective view of a swim fin device in a swim position, according to an embodiment of the disclosure.

As discussed above, embodiments of the present disclosure relate to a swimming aid and more particularly to a pivotable swim fin device. Generally, the pivotable swim fin device may comprise a walkable swim fin including a fin element hinged to a footwear element, such as a boot, allowing the fin element to be locked in an upward position against a leg of the wearer, and a downward position enabling the wearer to swim using the fin element as a swimming aid.

Referring now more specifically to the drawings by numerals of reference, there is shown in FIGS. 1-9, various views of a swim fin device 100 according to various embodiments of the present disclosure. As shown in these figures, the swim fin device 100 (or each of a pair of swim fin devices 100) may include a footwear element 110, a fin element 120 and a pivot element 140. The swim fin device 100 is particularly used for water activities such as, but not limited to, swimming, bodyboarding, kneeboarding, scuba diving, snorkeling, spearfishing, underwater diving, etc.

Figure 2:
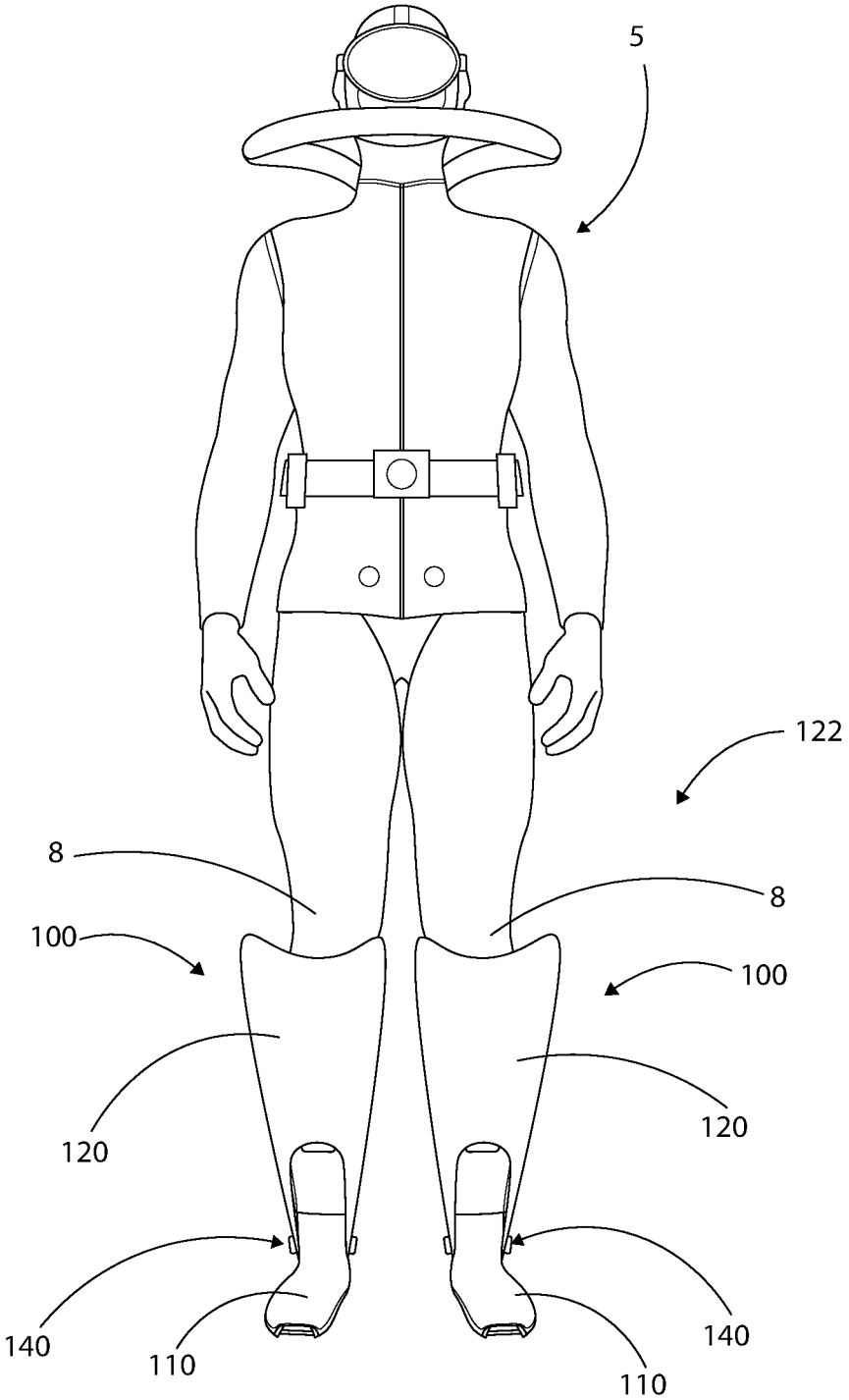
FIG. 2 is a perspective view of the swim fin device in a walking position, according to an embodiment of the disclosure.
Figure 3:
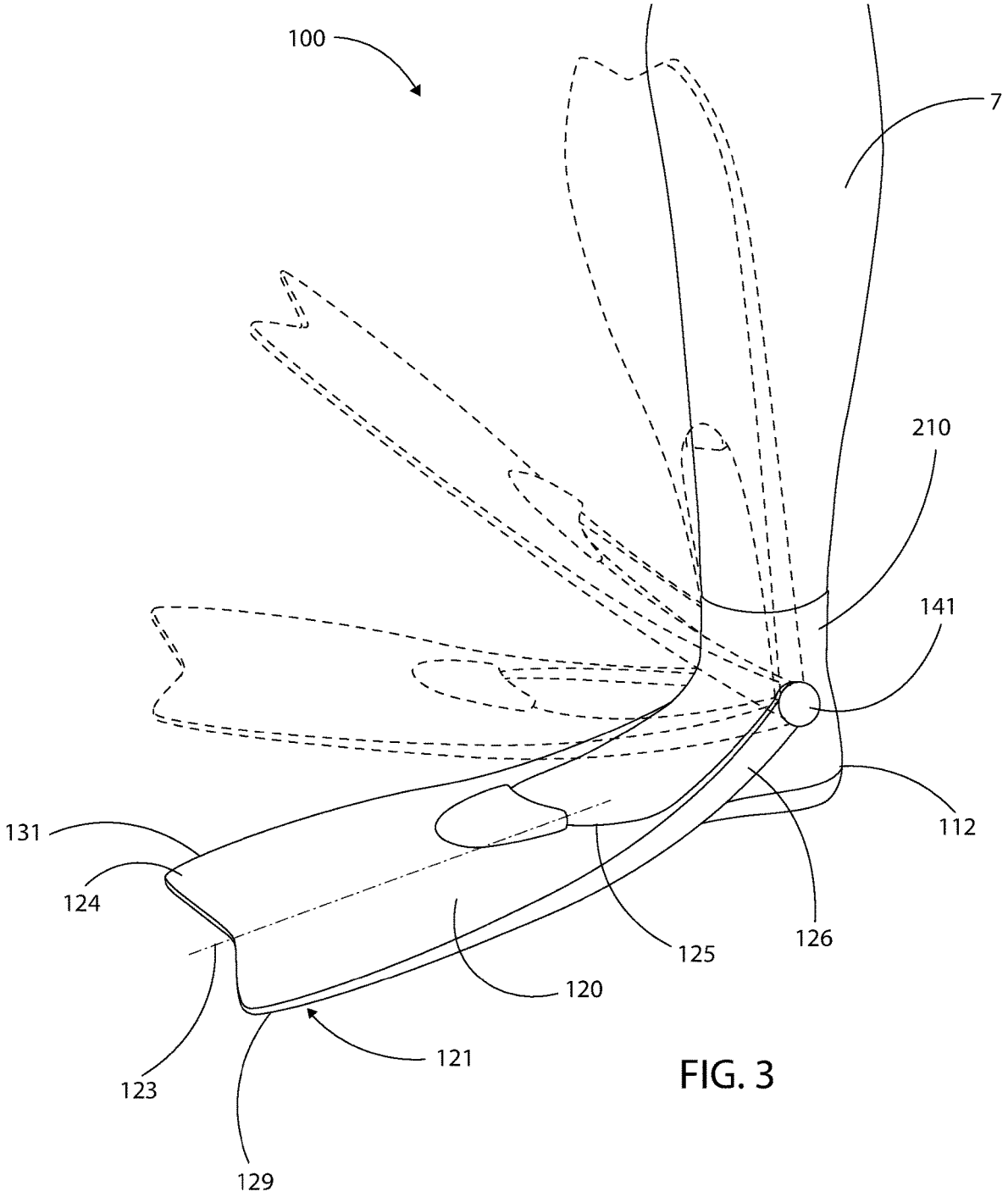
FIG. 3 is a side perspective view of the swim fin device and illustrating pivot direction of a fin element from the swim position, according to an embodiment of the present disclosure.
Figure 7:
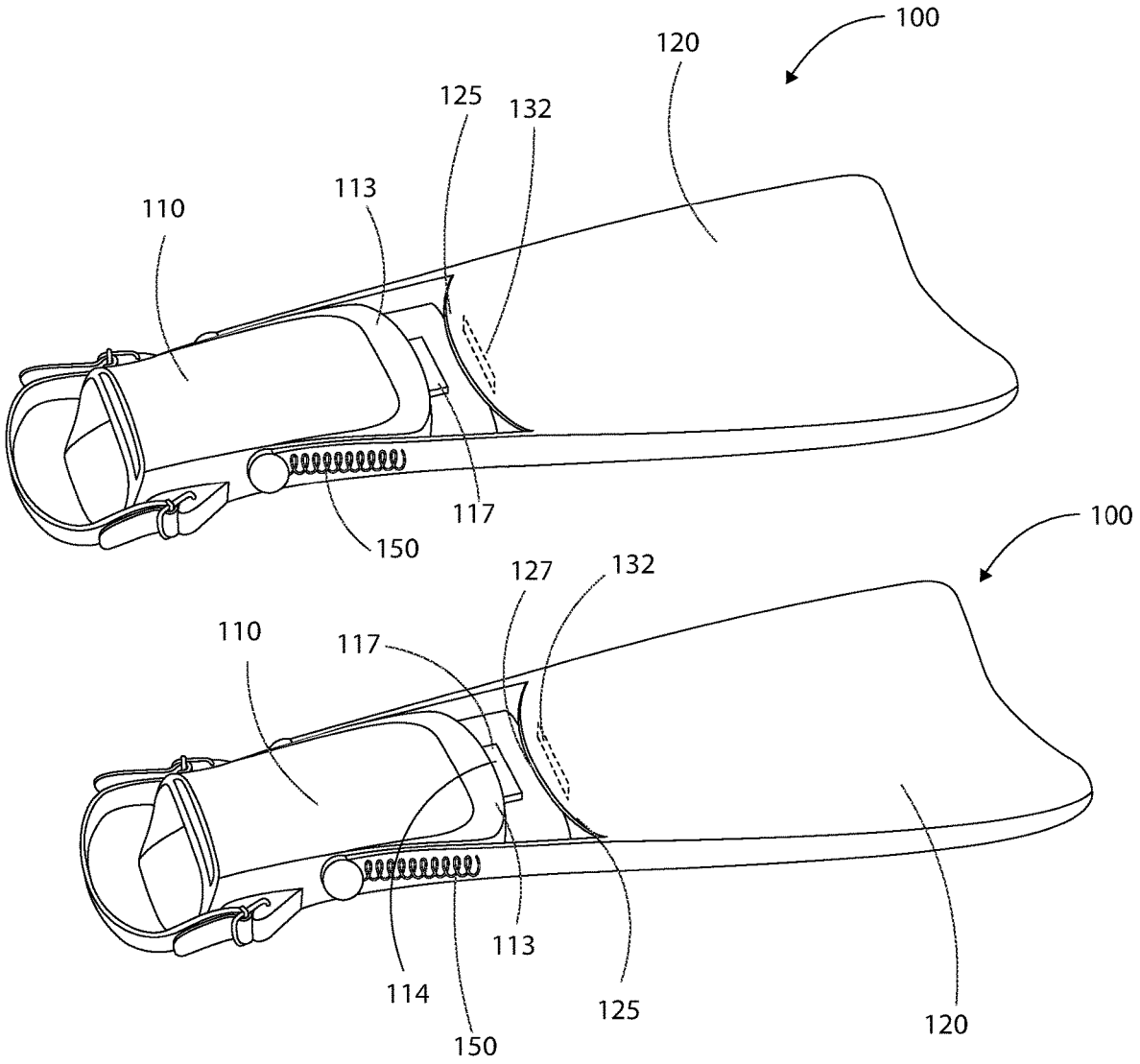
FIG. 7 is a perspective view of a lip member on the footwear element and a groove in the fin element which engage to lock the fin element to the footwear element in the swim position, according to another embodiment of the disclosure.
Figure 8:
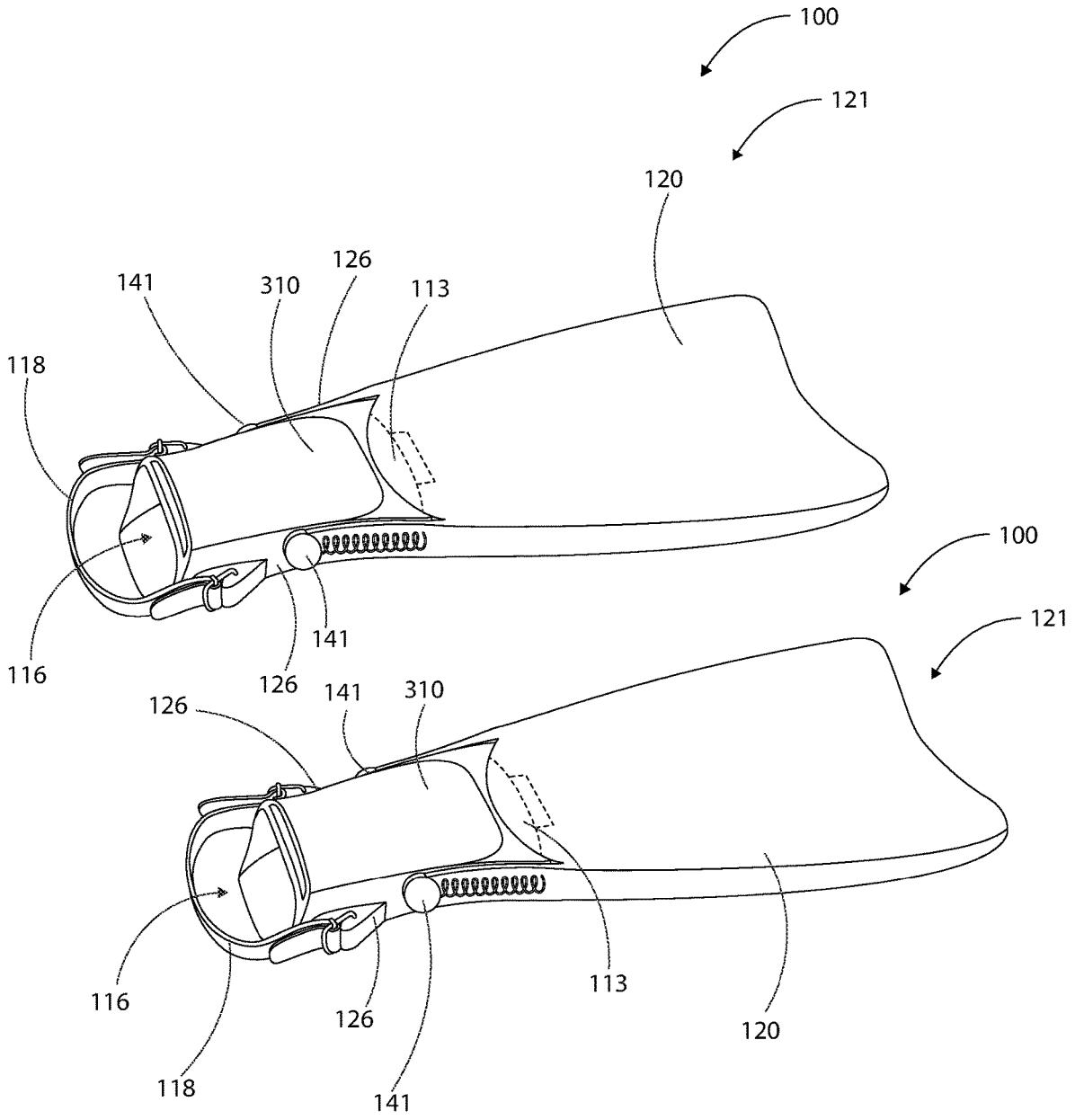
FIG. 8 is a perspective view of the swim fin device with the footwear element and the fin element locked together in the swim position, according to an embodiment of the disclosure.
Figure 9:
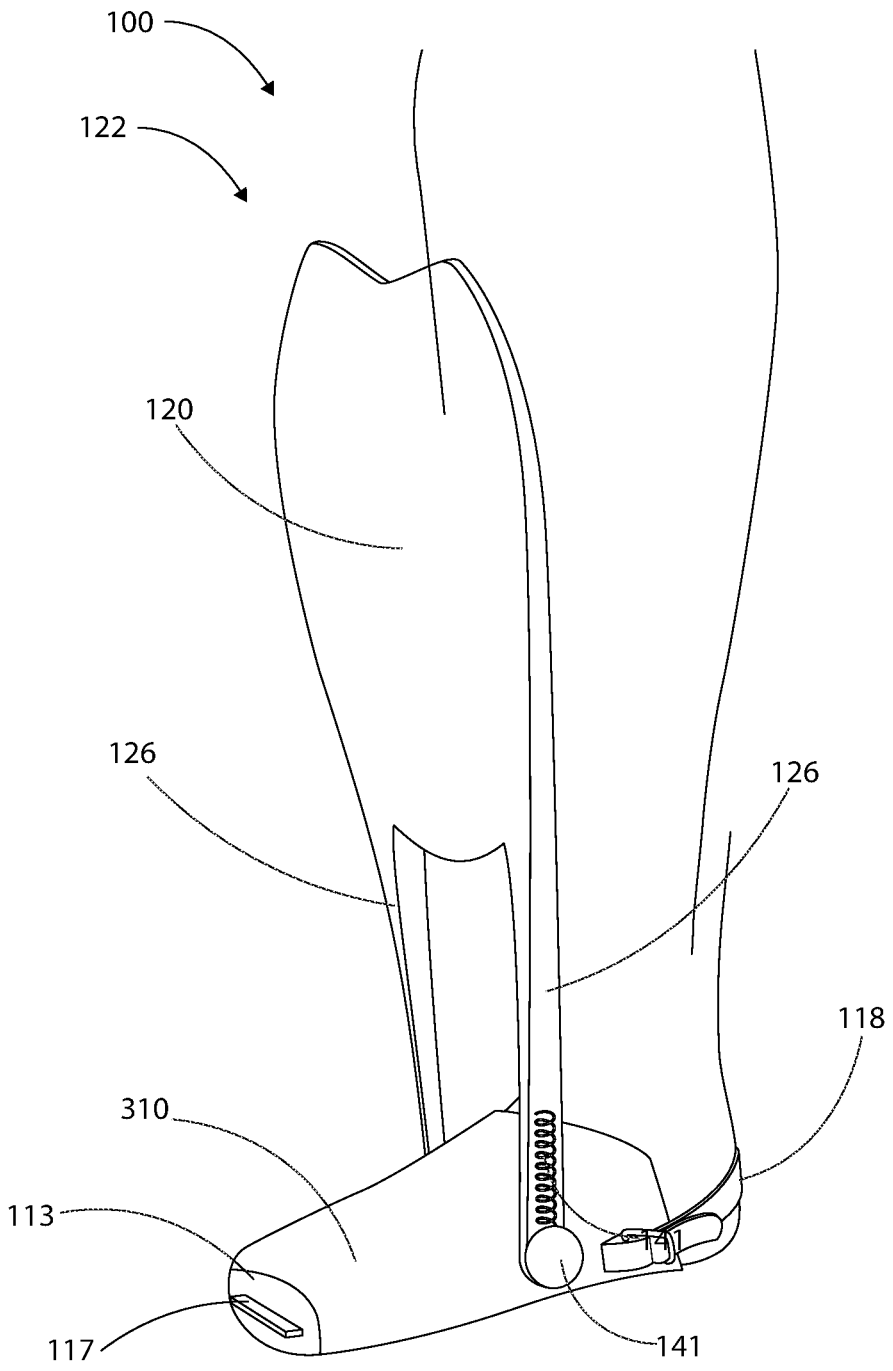
FIG. 9 is a side perspective view of the swim fin device in the walking position, according to an embodiment of the present disclosure.

As shown in FIGS. 1-3 the footwear element 110 is configured for wear on a foot 6 of a user 5. As shown, the footwear element 110 may include a front side 111 opposite a rear side 112 relative to the user 5—with the front side 111 being in front of the user 5 and the rear side 112 being behind the user 5. A toe portion 113 (FIG. 5) may be located at the front side 111 of the footwear element 110. As shown in FIGS. 1-3 and FIG. 5, the footwear element 110 may include (but is not limited to) a boot, or a 'boot element' 210. As shown, the boot element 210 may extend around the ankles of the user 5. In other embodiments, as shown in FIGS. 7-9, the footwear element 110 may include a slip-on shoe, or a 'slip-on shoe element' 310 (FIGS. 8-9). The slip-on shoe element 310 may include an ankle strap 118 for fastening the slip-on shoe element 310 around the ankle of the user 5. It should be appreciated that regardless the type of footwear, it is contemplated that the footwear element 110 may be worn with or without swim booties.

As demonstrated in FIGS. 1-5, the fin element 120 may be pivotably connected to the footwear element 110. The fin element 120 may include a body having a longitudinal axis 123 (FIG. 3) defining a front end 124 opposite a rear end 125 and a left side 129 opposite a right side 131, again relative to the user 5. The fin element 120 may be hydrodynamically shaped to aid in movement of the user 5 through water (when in a swim position 121 as shown in FIG. 1 and FIG. 3). For example, the fin element 120 may include a substantially planar, tapered body with a generally emarginate and/or truncate shaped front end 124 (i.e., shaped similar to an emarginate and/or truncate caudal fin of a fish).

Figure 4:
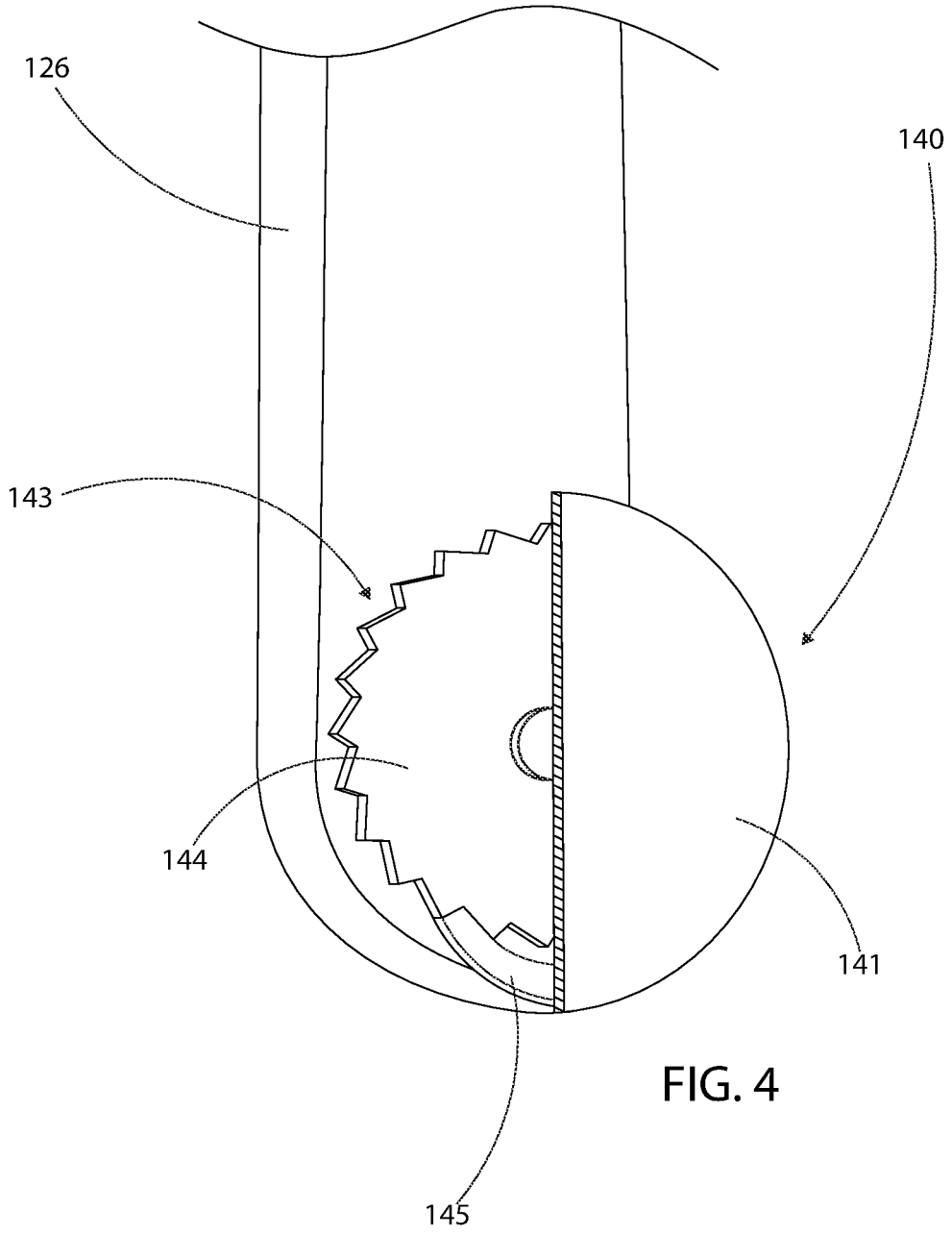
FIG. 4 is a cutaway section view of a pivot member including a ratchet mechanism, according to an embodiment of the present disclosure.
Figure 5:
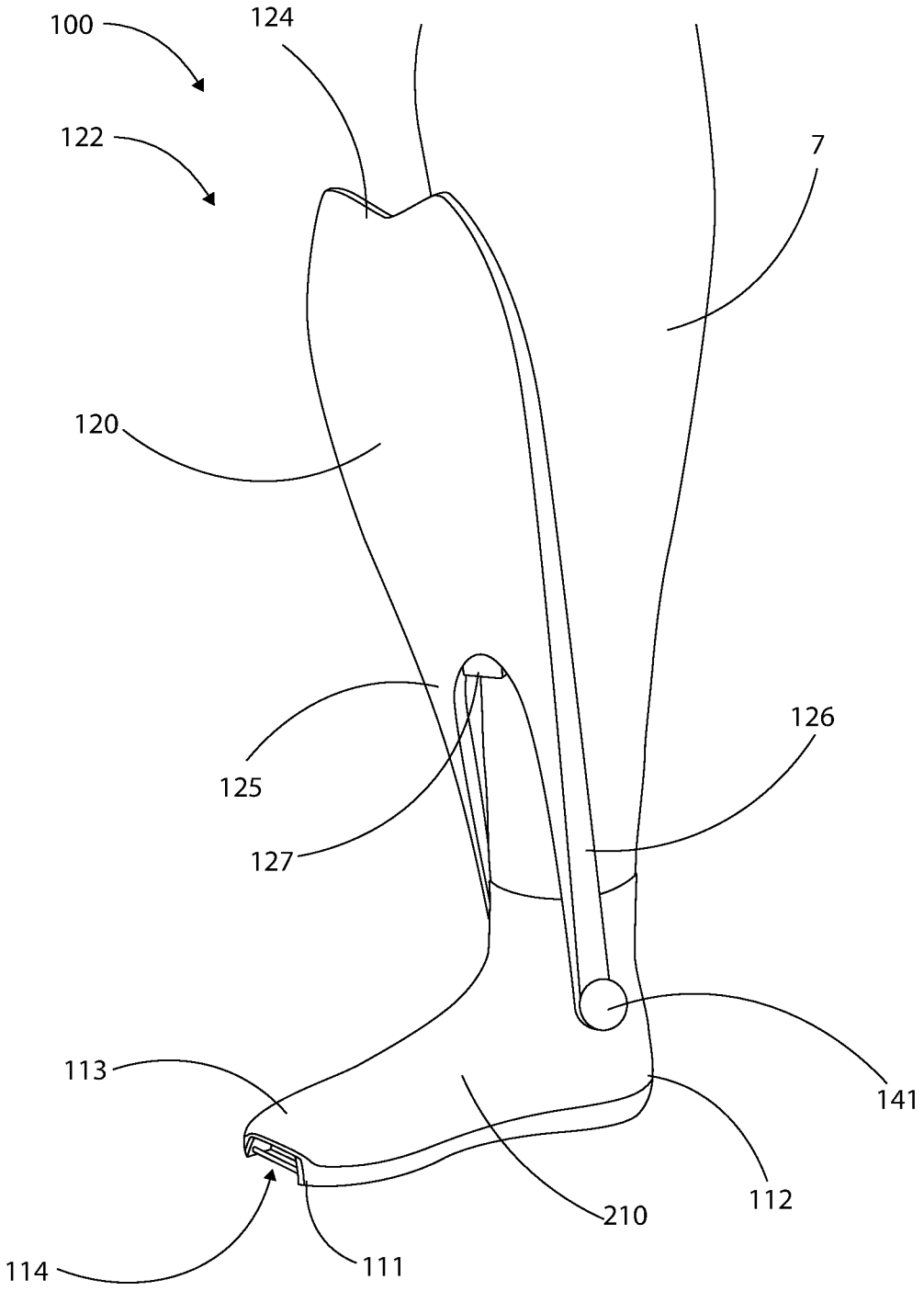
FIG. 5 is a side perspective view of the swim fin device shown in FIG. 3 in the walking position, according to an embodiment of the present disclosure.

As shown in FIGS. 1-5, and FIG. 3 in particular illustrating pivot direction of the fin element 120 from the swim position 121 via broken lines, the fin element 120 may be movable, or more specifically, pivotable between the swim position 121 (FIG. 1 and FIG. 3) and a walking position 122 (FIG. 2 and FIG. 5). As shown, the swim position 121 may include the fin element 120 being positioned in front of the foot 6 of the user 5, extending from the toe portion 113, such that the longitudinal axis 123 of the fin element 120 is generally perpendicular to a leg 7 of the user 5. Thereby, the fin element 120 acts as an extension of the foot 6 of the user 5 in the swim position 121, enabling the user 5 to easily move through the water during the water activity.

Further, as shown, the walking position 122 may include the fin element 120 being positioned upward against the leg 7 of the user 5 such that the longitudinal axis 123 of the fin element 120 is generally parallel to the leg 7. In particular, as shown, the fin element 120 may be pivotable about the front side 111 of the footwear element 110, over a horizontal axis (perpendicular the longitudinal axis 123). As such, in the walking position 122, the fin element 120 may be positioned against a front 8 of the leg 7 of the user 5 (about the shins of the user 5). Thus, the fin element 120 is positioned so as to not obstruct walking of the user 5.

As shown in FIGS. 2-5 and FIGS. 7-9, the pivot element 140 and a pair of arms 126 may be provided to facilitate the pivotable movement of the fin element 120. The pivot element 140 may enable the fin element 120 to lock into the swim position 121 and the walking position 122 to prevent inadvertent pivoting/movement thereof. As shown in FIGS. 3-5 particularly, the pivot element 140 may include a pair of circular members 141 attached at opposing sides of the footwear element 110 (one of the pair of circular members 141 at a left side of the footwear element 110 and another one of the pair of circular members 141 at a right side of the footwear element 110). The pair of circular members 141 may be removably attached to the footwear element 110, or the pair of circular members 141 may be fixed to the footwear element 110. It should be noted that due to both the pair of circular members 141 being alike, and both the pair of arms 126 being alike, the same reference numerals are used (respectively).

Each of the pair of arms 126 may attach between one of the pair of circular members 141 and one side (129 or 131-FIG. 3) of the fin element 120 (one of the pair of arms 126 at the left side of the footwear element 110 and the left side 129 of the fin element 120; and another one of the pair of arms 126 at the right side of the footwear element 110 and the right side 131 of the fin element 120). In some embodiments, as shown, the pair of arms 126 may be fixed to the sides 129, 131 (FIG. 3) of the fin element 120, about the rear end 125 thereof. For example, the pair of arms 126 may be integral to the body of the fin element 120 (e.g., forming a single structure) and extend rearwardly from the sides 129, 131 to attach to the pair of circular members 141. In some embodiments, the attachment of the pair of arms 126 to the pair of circular members 141 may be removable.

As above, the pivot element 140 may be configured to lock and prevent inadvertent pivotable movement of the fin element 120. Particularly, as shown in FIG. 4, in some embodiments, the pivot element 140 may include a pair of ratchet mechanisms 143. Each of the pair of ratchet mechanisms 143 may be housed in one of the pair of circular members 141 (one ratchet mechanism 143 and circular member 141 is shown here for the sake of brevity). The pair of ratchet mechanisms 143 may each include a gear 144 and a pawl 145 that engages with the gear 144 and locks the fin element 120 in one of the swim position 121 or the walking position 122. As such, in some embodiments, the pair of ratchet mechanisms 143 may be reversible.

In addition to this, in some embodiments as shown in FIG. 7, a pair of springs 150 may be provided at either side of the fin element 120 (one of the pair of springs 150 at the left side 129 of the fin element 120; and another one of the pair of springs 150 at the right side 131 of the fin element 120). The pair of springs 150 may together aid in movement of the fin element 120 between the swim position 121 and the walking position 122.

As shown in FIGS. 5-9, the swim fin device 100 may comprise a mechanism to lock the fin element 120 to the footwear element 110 in the swim position 121. This may further aid in preventing inadvertent pivoting of the fin element 120 during use of the swim fin device 100 in the water activity. Particularly, the toe portion 113 of the footwear element 110 (at the front end 124 of the footwear element 110) may include a first connector 114 (FIG. 5), and the rear end 125 of the fin element 120 may include a corresponding second connector 127 (FIG. 5) configured to engage with the first connector 114 and selectively lock the fin element 120 in the swim position 121.

Figure 6:
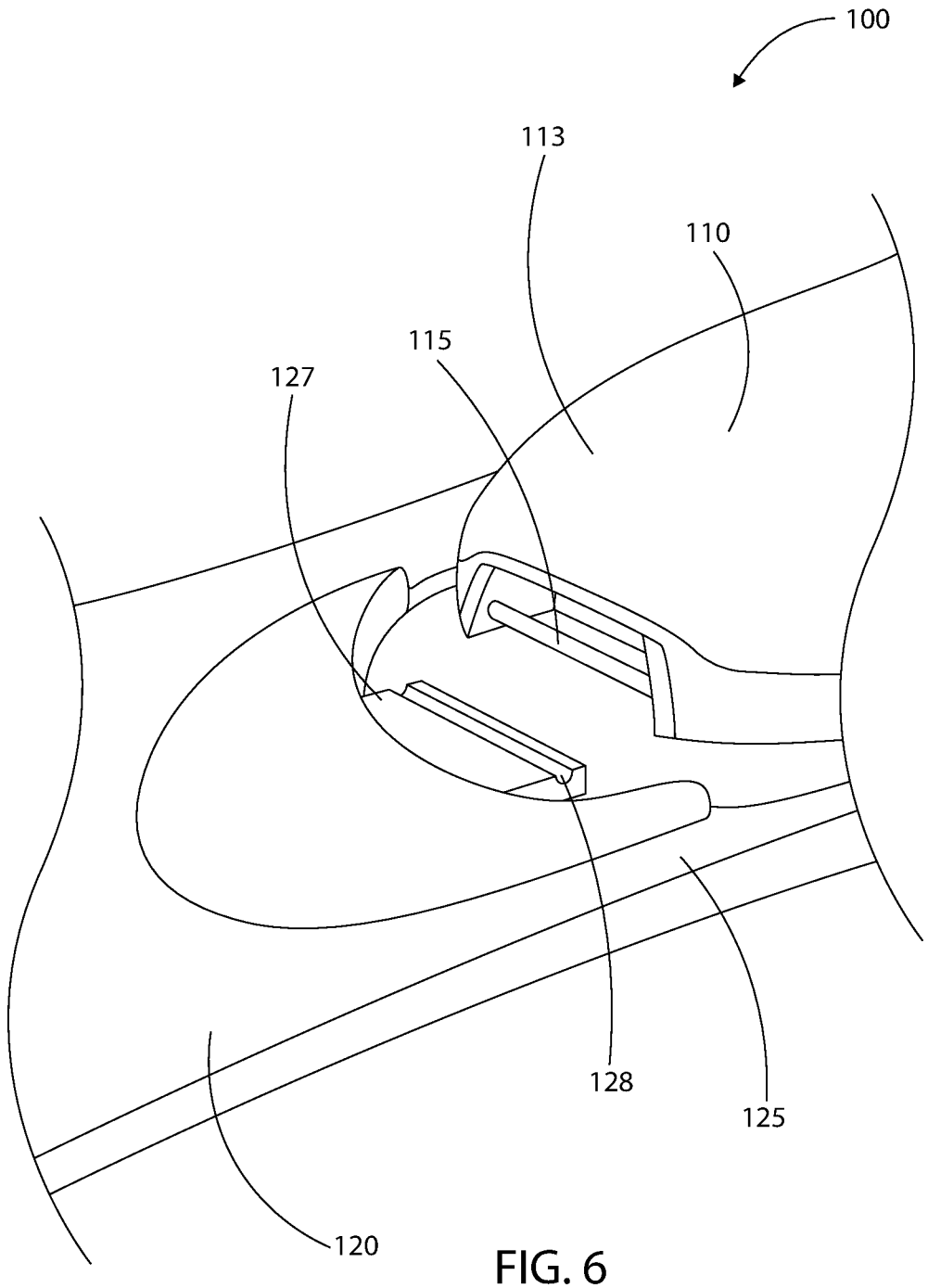
FIG. 6 is a close-up view of a bar member on a footwear element and a latch member on the fin element which engage to lock the fin element to the footwear element in the swim position, according to an embodiment of the present disclosure.

The mechanism may be similar to that of a cross-country ski binding system. For example, as shown in FIGS. 5-6 particularly, in some embodiments, the first connector 114 may include at least one bar member 115 recessed into the toe portion 113 of the footwear element 110, and the second connector 127 may include a cylindrical elongated socket 128 configured to receive the at least one bar member 115 therein. The cylindrical elongated socket 128 may be sized substantially equal to the at least one bar member 115, such that the at least one bar member 115 is contained therein. In some embodiments, the second connector 127 may also include a spring latch assembly (not illustrated) including a moveable member, such as a pin, that selectively latches over the at least one bar member 115 when engaged with the at least one ridge 128.

In other embodiments, as shown in FIGS. 7-9, the first connector 114 may include a lip member 117 protruding forwardly from the toe portion 114 of the footwear element 110. Correspondingly, the second connector 127 may include an elongated groove 132 recessed into the rear end 125 of the fin element 120 and configured to receive the lip member 117 therein. As demonstrated in FIG. 7, the lip member 117 may include a size generally equal to the elongated groove 132, enabling the lip member 117 to be held securely therewithin. It should be appreciated that the mechanism is not limited to the connectors 114, 127 discussed here or shown in these figures. Further, in some embodiments, as shown in FIGS. 7-9, the toe portion 114 may include a concavity in which the first connector 114 is disposed, and the rear end 125 of the fin element 120 may include a convex shape to at least partially fill the concavity when the first connector 114 is attached to the second connector 127.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

It should be noted that, in this specification and the drawings, elements that have substantially the same function and structure are denoted with the same reference signs, and repeated explanation and illustration is omitted. Further, common but well understood elements that are useful or necessary in a commercially feasible embodiment are often not depicted in order to facilitate a less obstructed view of the various embodiments of the present invention.

The numbered list format used in the claims of the application is used solely for organizational purposes to provide clarity thereto and is not meant to limit in any way the claimed matter nor any aspect of the present disclosure.

What is claimed is:

1. A swim fin device comprising:

a. a footwear element for wear on a foot of a user, the footwear element including an opening to receive the foot of the user, a front side opposite a rear side relative to the user, and a toe portion at the front side; and b. a fin element pivotably connected to the footwear element such that the fin element is movable between a swim position and a walking position, the fin element including a substantially planar body having a longitudinal axis defining a front end opposite a rear end, the body being hydrodynamically shaped to aid in movement of the user through water when in the swim position wherein the rear end of the fin element includes a corresponding second connector configured to engage with the first connector and selectively lock the fin element in the swim position;

c. and further comprising a pivot element including a pair of circular members attached at opposing sides of the footwear element, each of the pair of circular members housing a ratchet mechanism including a gear and a pawl, the pawl engaging with the gear to lock the fin element in one of the swim position and the walking position;

d. wherein the fin element further includes a pair of arms integral to sides of the fin element and extending rearwardly therefrom, each of the pair of arms attached between a respective one of the pair of circular members and a corresponding side of the fin element; and e. wherein a pair of springs are attached at opposing sides of the fin element, the pair of springs together aiding movement of the fin element between the swim position and the walking position.

2. The swim fin device of claim 1, wherein the body of the fin element is tapered from the rear end to the front end and includes one of a generally emarginate and truncate shaped front end.

3. The swim fin device of claim 2, wherein the swim position includes the fin element being positioned in front of the foot of the user with the longitudinal axis generally perpendicular to a leg of the user, and wherein the walking position includes the fin element being positioned upward against a front of a leg of the user with the longitudinal axis of the fin element being generally parallel to the leg of the user.

4. The swim fin device of claim 1, wherein the footwear element comprises a boot.

5. The swim fin device of claim 1, wherein the footwear element comprises a slip-on shoe, the slip-on shoe including an ankle strap for fastening the slip-on shoe around an ankle of the user.

6. A swim fin device comprising:

a. a boot element for wear on a foot of a user, the boot element including an opening to receive the foot of the user, a front side opposite a rear side relative to the user, and a toe portion at the front side, the toe portion including a first connector; and b. a fin element including a body having a longitudinal axis defining a front end opposite a rear end, the body being hydrodynamically shaped to aid in movement of the user through water, the fin element being pivotably connected to the boot element such that the fin element is movable between a swim position and a walking position, the swim position including the fin element being positioned in front of the foot of the user with the longitudinal axis generally perpendicular to a leg of the user, the walking position including the fin element being positioned upward against the leg of the user with the longitudinal axis of the fin element being generally parallel to the leg of the user, and wherein the rear end of the fin element includes a corresponding second connector configured to engage with the first connector on the boot element and selectively lock the fin element in the swim position, c. wherein the device further comprises a pivot element including a pair of circular members attached at opposing sides of the boot element, each of the pair of circular members housing a ratchet mechanism including a gear and a pawl, the pawl engaging with the gear to lock the fin element in one of the swim position and the walking position;

d. wherein the fin element further includes a pair of arms integral to sides of the fin element and extending rearwardly therefrom, each of the pair of arms attached between a respective one of the pair of circular members and a corresponding side of the fin element;

e. and wherein a pair of springs are attached at opposing sides of the fin element, the pair of springs together aiding movement of the fin element between the swim position and the walking position.

7. The swim fin device of claim 6, wherein the body of the fin element is tapered from the rear end to the front end and includes one of a generally emarginate and truncate shaped front end.

8. The swim fin device of claim 7, wherein the walking position includes the fin element being positioned upward against a front of the leg of the user.

9. A swim fin device comprising:

a. a slip-on shoe element for wear on a foot of a user, the slip-on shoe element including an opening to receive the foot of the user, an ankle strap for fastening the slip-on shoe around an ankle of the user, a front side opposite a rear side relative to the user, and a toe portion at the front side, the toe portion including a first connector; and b. a fin element including a body having a longitudinal axis defining a front end opposite a rear end, the body being hydrodynamically shaped to aid in movement of the user through water, the fin element being pivotably connected to the slip-on shoe element such that the fin element is movable between a swim position and a walking position, the swim position including the fin element being positioned in front of the foot of the user with the longitudinal axis generally perpendicular to a leg of the user, the walking position including the fin element being positioned upward against the leg of the user with the longitudinal axis of the fin element being generally parallel to the leg of the user, and wherein the rear end of the fin element includes a corresponding second connector configured to engage with the first connector on the slip-on shoe element and selectively lock the fin element in the swim position;

c. wherein the device further comprises a pivot element including a pair of circular members attached at opposing sides of the slip-on shoe element, each of the pair of circular members housing a ratchet mechanism including a gear and a pawl, the pawl engaging with the gear to lock the fin element in one of the swim position and the walking position;

d. wherein the fin element further includes a pair of arms integral to sides of the fin element and extending rearwardly therefrom, each of the pair of arms attached between a respective one of the pair of circular members and a corresponding side of the fin element; and e. wherein a pair of springs are attached at opposing sides of the fin element, the pair of springs together aiding movement of the fin element between the swim position and the walking position.

10. The swim fin device of claim 9, wherein the body of the fin element is tapered from the rear end to the front end and includes one of a generally emarginate and truncate shaped front end.

11. The swim fin device of claim 9, wherein the walking position includes the fin element being positioned upward against a front of the leg of the user.

* * * * *